US005170043A

United States Patent [19]

Gunnufson

[11] Patent Number: 5,170,043

[45] Date of Patent: Dec. 8, 1992

[54] ELECTRIC POWERED DEVICE SAFE FROM HARMFUL ELECTROMAGNETIC FIELDS

[76] Inventor: Morris C. Gunnufson, 484 Wakas Tr., Flagstaff, Ariz. 86001

[21] Appl. No.: 658,973

[22] Filed: Feb. 21, 1991

[51] Int. Cl.[5] ..... H05B 3/34

[52] U.S. Cl. ..... 219/528; 219/212

[58] Field of Search ..... 219/212, 528, 529, 549; 363/39, 44, 45, 46

[56] References Cited

U.S. PATENT DOCUMENTS

| | | | |
|---|---|---|---|
| 3,555,398 | 1/1971 | Nestorovic | 363/45 |
| 3,783,367 | 1/1974 | Yamamoto | 321/11 |
| 3,869,566 | 3/1975 | Smith | 178/7.2 |
| 4,013,936 | 3/1977 | Hesler | 363/46 |
| 4,298,924 | 11/1981 | Genuit | 363/46 |
| 4,888,675 | 12/1989 | Kumar | 363/47 |
| 4,931,625 | 6/1990 | Marlinski | 219/528 |
| 5,036,177 | 7/1991 | Pagliarini | 219/212 |

*Primary Examiner*—Teresa J. Walberg

[57] ABSTRACT

An electric powered device and method includes of a power control system (24), an alternating current to direct current converter (30) and a direct current filtering system (36). After the incoming power has been processed by these sections, the power is provided for use at the load for the intended function of the electrical system (FIG. 1). The by-pass capacitors (38) provide additional protection by grounding extraneous alternating currents at ground potential (42). The principle method here is to hold the current as steady and constant as possible to maintain a constant electromagnetic field. This process renders electromagnetic fields safe from potential hazards. Whenever current levels need to be changed for control purposes, the rates of this change are reduced as much as possible in order to reduce any stresses imposed upon any biological systems immersed in the electromagnetic field generated by the device in use.

13 Claims, 3 Drawing Sheets

ELECTRIC POWERED DEVICE SAFE FROM HARMFUL ELECTROMAGNETIC FIELDS

BACKGROUND

1. Field of Invention

This invention relates to a means for enhancing the safety of electrical devices which expose persons to the hazards of electromagnetic fields.

2. Description of Prior Art

Within the past decade, researchers have reported higher risks of disease by users of electric blankets, waterbed heaters, ceiling heating elements and other electrical devices.

After doing some basic research with the effects of electromagnetic fields and currents, this inventer concluded that the reason electromagnetic fields can be hazardous at the field strength commonly encountered is due to the fact that the field intensity changes with respect to time. This led to the conception of a device that would limit the changing nature of the power provided for use. These conclusions were confirmed by testing a number of proto-types that incorporated these ideas.

This testing has identified four sources of hazardous fields.

They are:

(a) the basic operating frequency of the power generator, 60 hertz being the most common.

(b) a broad spectrum of frequencies picked up by power lines from a number of different sources.

(c) switching and power control.

(d) ambient sources of electromagnetic fields and radiation not connected with the device being used.

The testing done here did not reveal any negative effects from 100 milligauss or less constant magnetic fields. These field intensity levels are greater than most common domestic electrical devices generate. However, when exposed to time varying field intensities, negative reactions were observed most of the time. Some positive reactions were observed for some frequencies for short periods of time.

When a person is exposed to 50 hertz, 60 hertz or other random frequencies, negative reactions were observed most of the time. If some very small negative effects from the converted constant magnetic field are present, they are undetectable by any testing method available. Whatever the outcome of future research on this subject, the evidence collected as of this date clearly shows that the major portion of the hazards of electromagnetic fields is due to the intensity changes with respect to time.

If it becomes necessary to change the current level for control purposes or for other reasons, then this change should be made as gradually and slowly as possible or practical. The inventer has given this process the nicknames, "power softening" or "field softening". Also, a device that performs this function is referred to as a "power softener" or "field softener".

One theory that can explain this, is the law or theory of magnetic induction. The theory of magnetic induction states that any conductor in a magnetic field that is changing in strength with respect to time will have a voltage induced upon it, and that voltage is proportional to the rate of change of magnetic field intensity. If living systems are in a changing magnetic field, then electric currents would be generated within these systems, thus inducing stresses upon these living systems.

By reducing the switching rate, higher induced voltages in biological systems can be avoided.

A prior patent which addresses this problem is an expensive and elaborate shielding device for heating pads and electric blankets, U.S. Pat. No. 4,931,625 to Marlinski (1990).

Another prior patent that is more closely related to this patent application is U.S. Pat. No. 5,036,177 to Pagliarini (1991). This patent does protect the user from the primary alternating current frequency but offers little protection to other electromagnetic hazards such as switching and nearby ambient fields.

Also the Pagliarini patent rectified and filtered prior to the control circuits, and as a result, this would cause the controls in some electric blankets to malfunction. This is because the current ratings of some bi-metal control contacts are marginal for the ac power applied and are not able to operate with the same power levels with dc. However, the scheme proposed here, filtration after the control process, eliminates this problem as well as providing better protection to the user.

SUMMARY OF THE INVENTION

It is an object of the present invention to reduce the hazard experienced by users of electrical devices. It is a further object to do so economically and efficiently with minimal retooling or replacement of existing devices.

Further objects and advantages of my invention will become apparent from a consideration of the drawings and ensuing description of it.

DESCRIPTION OF THE PREFERRED EMBODIMENTS

Figure 1:
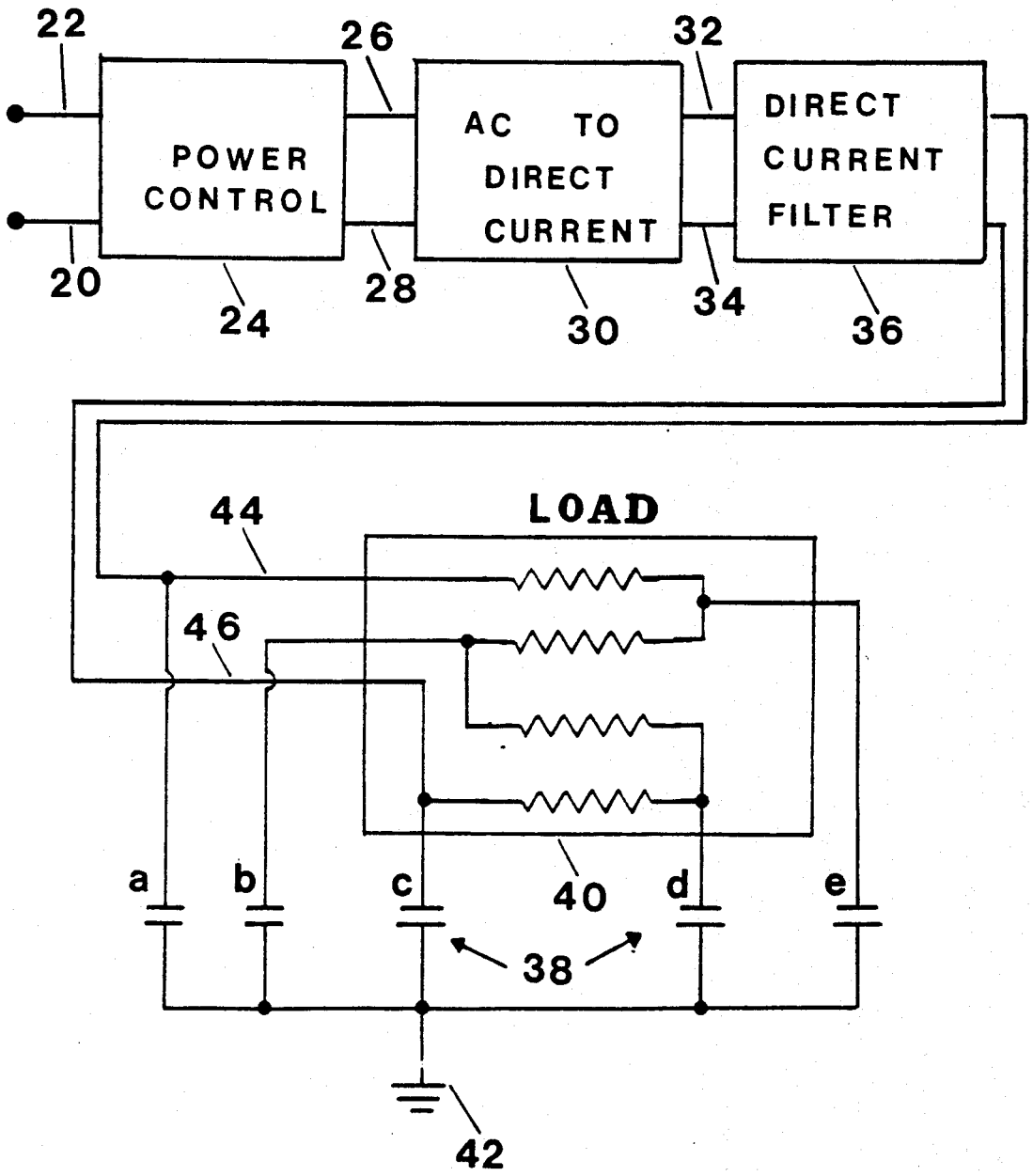
FIG. 1 is a block diagram of an electrical powered device that is in accordance with this invention.

FIG. 1 shows how these teachings are applied. The most common power source available is sixty hertz single or poly phase which is fed to wires 22 and 20. The power is delivered to power controller 24. The power is transferred to the alternating current to direct current converter 30 by the wires 26 and 28. If the voltage potential is measured across the wires 26 and 28 with respect to time, as seen on an oscilloscope, a sine wave alternating voltage would be observed. The alternating current to direct current converter converts all current flow in the same direction. The current in this form is transferred to the filter 36 by wires 32 and 34 as seen in FIG. 1. The current filter 36 then removes any alternating current components and direct current is moved to the electrical load 40 through the wires 44 and 46. This voltage between the wires 44 and 46 would be constant.

Figure 2:
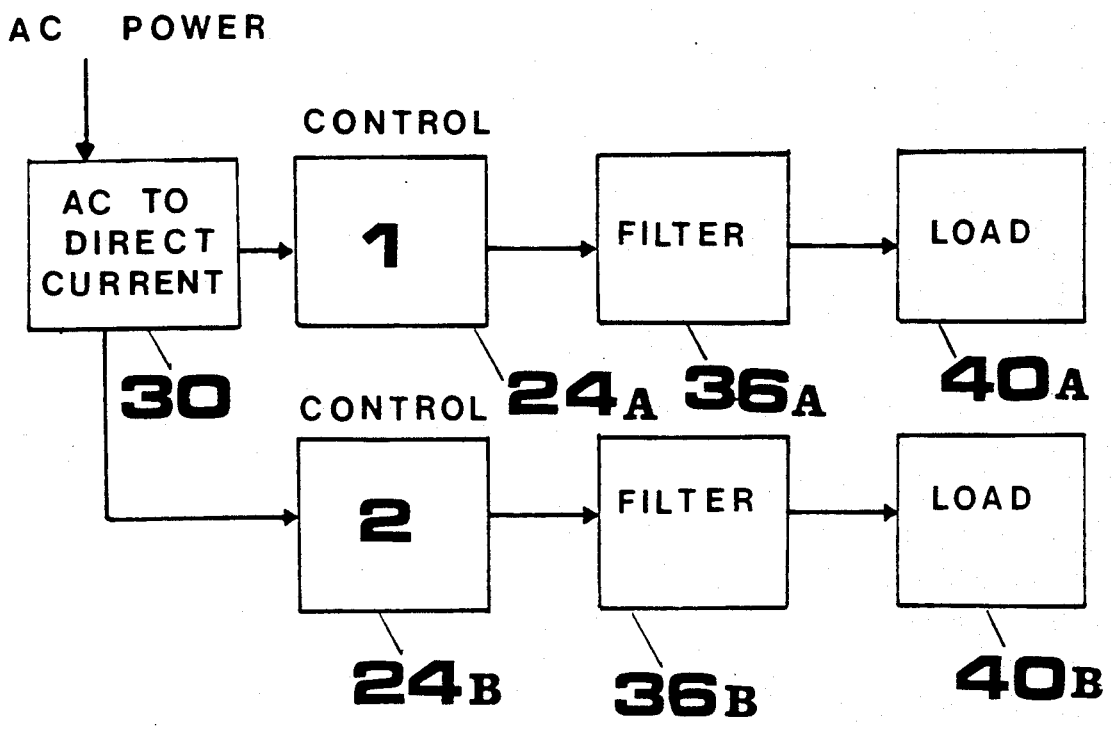
FIG. 2 is another possible block diagram of an electrical powered device that is also in accordance with this invention.

The by-pass capacitors 38 of FIG. 1 and 2 have two functions. One is to provide a low impedance path to ground for alternating current. If alternating current were to get past the filter 36 then a low resistance path would be provided to ground. This would reduce the amplitude of that alternating current. The second function goes beyond rendering electromagnetic fields safe.

This loading element would act as a shield, protecting biological systems from the fields or waves present. If the loading element were struck by such fields, then currents would be induced and shorted to ground 42 through these by-pass capacitors 38.

If the type of controller that responds to the demand by shutting on and off is used, then the arrangement shown in FIG. 1 would be preferred.

The very rapid voltage rise and rapid voltage drop are a result of the switching. Voltage changes are the result of ideal switching. The rectangle shape wave form is rich in harmonics and it is likely that other frequencies would also be introduced because of bouncing and arcing of contact points.

However, if the arrangement of FIG. 1 is used, then many of these introduced frequencies are filtered out. This more gradual change is less stressful to biological systems because currents induced in these systems are less than when induced by harmonic-rich changes in electromagnetic fields.

FIG. 2 is another variation of this patent and a block diagram. The AC to DC converter 30 is the first step, and the power is sent to controllers 24*a* and 24*b*. From each controller the power is sent on to each side of the load 40*a* and 40*b* after passing through the filters 36*a* and 36*b*. The block diagram shown in FIG. 2 is a very practical arrangement used with dual-controlled electric blankets.

When two of the same component are used, they are designated as a and b. Controller 1 and 2 each control one half of the electric blanket.

Some of the heated bi-metal strip controllers, 68*a* and 68*b*, that are commonly used with electric blankets do not work well with direct current, because alternating current periodically drops to zero voltage. This drop reduces arcing on the contact points. When direct current is used, more arcing is common, which sometimes causes the contact points to stick or freeze together.

It was found that full-wave rectified current works just as well as alternating current since the voltage also periodically drops to zero.

Figure 3:
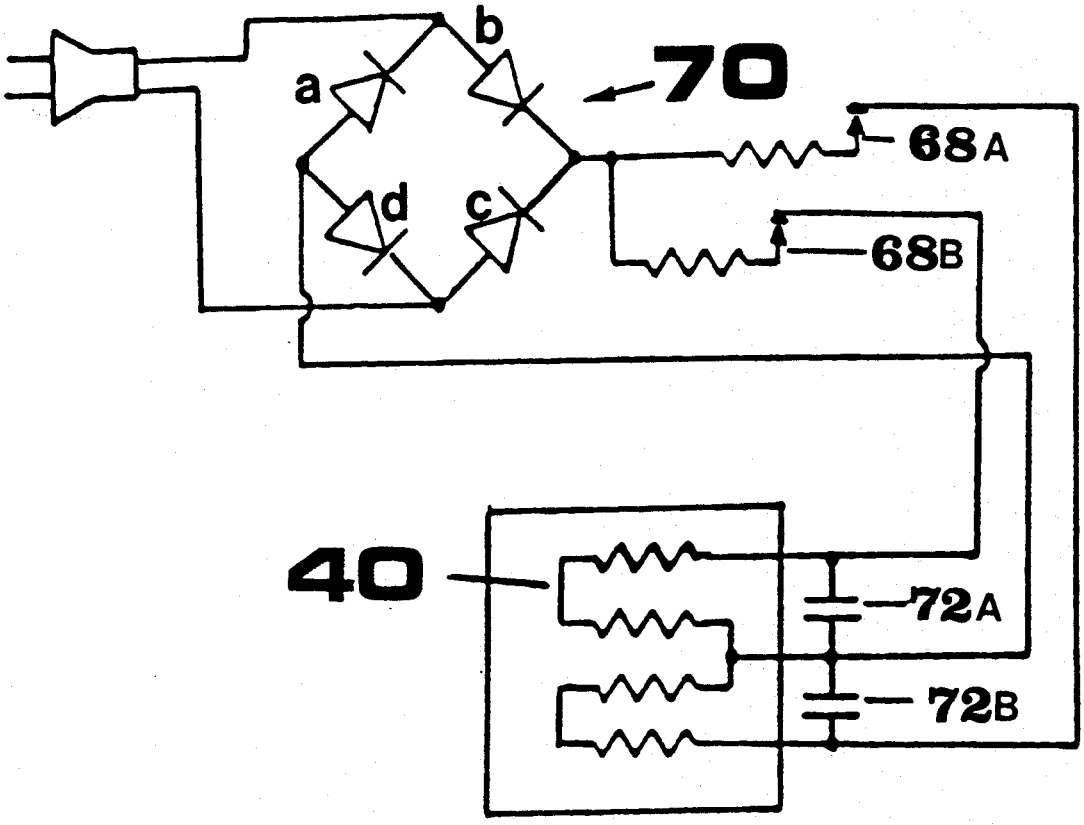
FIG. 3 is a schematic arrangement for use with dual controlled electric blankets and based upon the block diagram in FIG. 2.

FIG. 3 is a schematic based upon the diagram of FIG. 2. In FIG. 3 the power is first processed by the rectifier bridge 70 and then sent to the heated bi-metal strip controllers 68*a* and 68*b*. The current is filtered by capacitors 72*a* and 72*b* before going to the respective loads of each side of the load 40.

The loads marked 40*a* and 40*b* of FIG. 3 correspond to each side of the load 40 in FIG. 3.

As shown in FIG. 3 and 4, the filtration is done after the control process by filter capacitors 72*a* and 72*b*. This also removes many of the frequencies injected by the controllers 68*a* and 68*b* thus causing the electric current flow rate to change more gradually.

SUMMARY, RAMIFICATIONS, AND SCOPE

Accordingly, the reader will see that this patent provides an inexpensive and simple solution to the problem of hazardous electromagnetic fields produced by electrical devices. It can be seen that this patent is an important step in reducing the hazards of modern life.

Although the description above contains many specificities, these should not be construed as limiting the scope of the invention but as merely providing illustrations of some of the presently preferred embodiments of this invention. Many other wiring diagrams are possible that are embodiments of this patent.

Thus, the scope of the invention should be determined by the appended claims and their legal equivalents, rather than by the examples given.

I claim:

1. A method for reducing the hazardous effects of electromagnetic fields generated from electrically powered devices, comprising the steps of:

a. converting electric current flow to be uni-directional through a device while said device is operating, b. maintaining a constant current flow rate with respect to time during operation of said device, c. controlling power to an electrical load of the device by use of power controls, and d. changing said electric current flow rate gradually when operational load demands of said device require a change of current flow rate by filtering said current after said power controls.

2. An electrical powered device safe from electromagnetic field hazards, comprising:

a. process means for processing incoming electrical power such that a constant steady current is provided to a main electrical load;

b. means for reducing rapid, abrupt changes of load current to slow gradual changes to reduce harmonic content of the current induced electromagnetic fields produced by said device; and c. further including within said device a plurality of pathways for alternating current to ground potential, said pathways being at points distributed throughout the main electrical load of said device.

3. An electrical powered load of claim 2 wherein said device is an electrical resistance heating element.

4. An electrical powered device of claim 3 wherein said device is physically placed where generated electromagnetic fields of said device may be harmful to biological organisms when electrical power supplied to said device is un-treated.

5. An electrical powered device of claim 2 wherein said device is physically placed where generated electromagnetic fields of said device may be harmful to biological organisms when electrical power supplied to said device is un-treated.

6. An electrical powered device safe from electromagnetic field hazards, comprising:

a. a direct current power source providing power to a main load b. means coupled to said power source for reducing the electrical current intensity rate of changes for power control of said device as permitted by operational demands of said device, c. wherein a plurality of alternating current pathways are provided to ground potential at intervals throughout the main load of said device.

7. An electrical powered device of claim 6 wherein said load is an electrical resistance heating element.

8. An electrical powered device of claim 7 wherein said device is physically placed where generated electromagnetic fields of said device may be harmful to biological organisms when electrical power supplied to said device is un-treated.

9. An electrical powered device of claim 6 wherein said device is physically placed where generated electromagnetic fields of said device may be harmful to biological organisms when electrical power supplied to said device is un-treated.

10. In an electric heating device having means for connecting a main load to a source of AC power, the improvement comprising:

(a) a DC power source coupled to said device for energizing said device with DC power in lieu of AC power, (b) whereby a person using said electric heating device will not be subjected to an alternating electromagnetic field of the type emanating from said device when said device is powered from an AC power source, (c) wherein a plurality of alternating current pathways are provided to ground potential at intervals throughout the main load of said device.

11. An electrical powered device of claim 10 wherein said load is an electrical resistance heating element.

12. An electrical powered device of claim 11 wherein said device is physically placed where generated electromagnetic fields of said device may be harmful to biological organisms when electrical power supplied to said device is un-treated.

13. An electrical powered device of claim 10 wherein said device is physically placed where generated electromagnetic fields of said device may be harmful to biological organisms when electrical power supplied to said device is un-treated.

* * * * *